US007291045B2

(12) United States Patent
Wu

(10) Patent No.: US 7,291,045 B2
(45) Date of Patent: Nov. 6, 2007

(54) MULTI-FUNCTIONAL ORNAMENTAL LIGHTING EQUIPMENT

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 232 days.

(21) Appl. No.: 11/045,434

(22) Filed: Jan. 28, 2005

(65) Prior Publication Data

US 2006/0039147 A1 Feb. 23, 2006

Related U.S. Application Data

(63) Continuation-in-part of application No. 10/920,920, filed on Aug. 18, 2004.

(51) Int. Cl.
*H01R 33/00* (2006.01)

(52) U.S. Cl. ..... 439/660

(58) Field of Classification Search ..... 439/660, 439/537, 650, 790, 36, 587, 275, 271; 362/226, 362/406

See application file for complete search history.

(56) References Cited

U.S. PATENT DOCUMENTS

| | | | | |
|---|---|---|---|---|
| 4,721,480 | A * | 1/1988 | Yung | 439/527 |
| 5,738,496 | A * | 4/1998 | Mehta | 417/44.1 |
| 6,790,092 | B2 * | 9/2004 | Parsadayan et al. | 439/650 |
| 6,796,827 | B1 * | 9/2004 | Chen | 439/348 |

* cited by examiner

*Primary Examiner*—J. F. Duverne
(74) *Attorney, Agent, or Firm*—McGlew and Tuttle, P.C.

(57) ABSTRACT

A multi-functional ornamental lighting equipment is set forth. This equipment comprises an ornamental lighting load connected to form a plurality of branch circuits; a function controller formed of a variety of electric and electronic components operable for various prescribed functions, and having a power supply input terminal and an output terminal to the multi-branched circuit; a connecting junction composed by a male connector and a female connector, there is a plurality of electric wires installed inside the connecting junction, one end of said electric wires is connected to said ornamental lighting load, while the other end is connected to a plug, and a space is provided inside the connecting junction for installation of function controller.

7 Claims, 8 Drawing Sheets

MULTI-FUNCTIONAL ORNAMENTAL LIGHTING EQUIPMENT

This is a Continuation-in-Part of application Ser. No. 10/920,920 filed Aug. 18, 2004, and the entire disclosure of this prior application is considered to be part of the disclosure of the accompanying application and is hereby incorporated by reference therein.

BACKGROUND OF THE INVENTION

1. Field of the Invention

The present invention relates to multi-functional ornamental lighting equipment, and more particularly to an ornamental lighting equipment which includes a function controller installed in a connecting junction so as to provide the ornamental lighting load with a function to perform a variety of light changing states.

2. Description of the Prior Art

The ornamental lighting equipment which creates a joyful atmosphere is usually composed of strings of incandescent lamps or LEDs as a light source with its one end connected to a power source and resting the assembly on a supporting frame such as a Christmas tree, or a picturesquely styled stand.

In order to enhance the light variation, a function controller is provided between the power source and the lighting equipment to control the flashing fashion of the lighting equipment. In the prior arts, there were many analogous ornamental lighting equipment disclosed or put into practice such as U.S. Pat. No. 6,653,757 "Apparatus and Method for Providing Synchronized Lights", U.S. Pat. No. 6,559,605 "Synchronous Multiple Serial Lamp Sets", U.S. Pat. No. 6,170,964 "Ornamental Lighting Device with a flexibly Separable Light Emitting Tube Capable of Portraying User's Designed Signs in a Flickering Manner", U.S. Pat. No. 5,834,901 "Flashing Light String Assembly with a Pair of Sub-light Strings per Plug", and U.S. Pat. No. 5,150,964 "Joy Light Structure" etc.

All the aforesaid cited cases provided their individual features in the interconnection scheme of the ornamental lamps, but there is a significant shortcoming of disorganization in the fastening and assembling manners especially when the number of the electric conductors and lumped lamps is increased.

In view of such a defect inherent to the prior art, an improvement is seriously required.

The inventor has dedicated great efforts for years to studying and improving this defect and come up with a novel multi-functional ornamental lighting equipment as provided in this invention whose structure is sure to eliminate the defect mentioned above.

SUMMARY OF THE INVENTION

Accordingly, it is an object of the present invention to provide a multi-functional ornamental lighting equipment which is composed of an ornamental lighting load, a function controller, a plug to the power source, and a connecting junction so that the lighting load is capable of performing a variety of light changing state.

Another object of the present invention is to provide a multi-functional ornamental lighting equipment in which the assembly of the lighting equipment can be neatly and simply constructed and operated easily and conveniently through the function controller installed inside the connecting junction.

The above objects and other advantages of the present invention will become more apparent by describing in detail the preferred embodiments of the present invention with reference to the attached drawings.

DETAILED DESCRIPTION OF THE PREFERRED EMBODIMENTS

Figure 1:
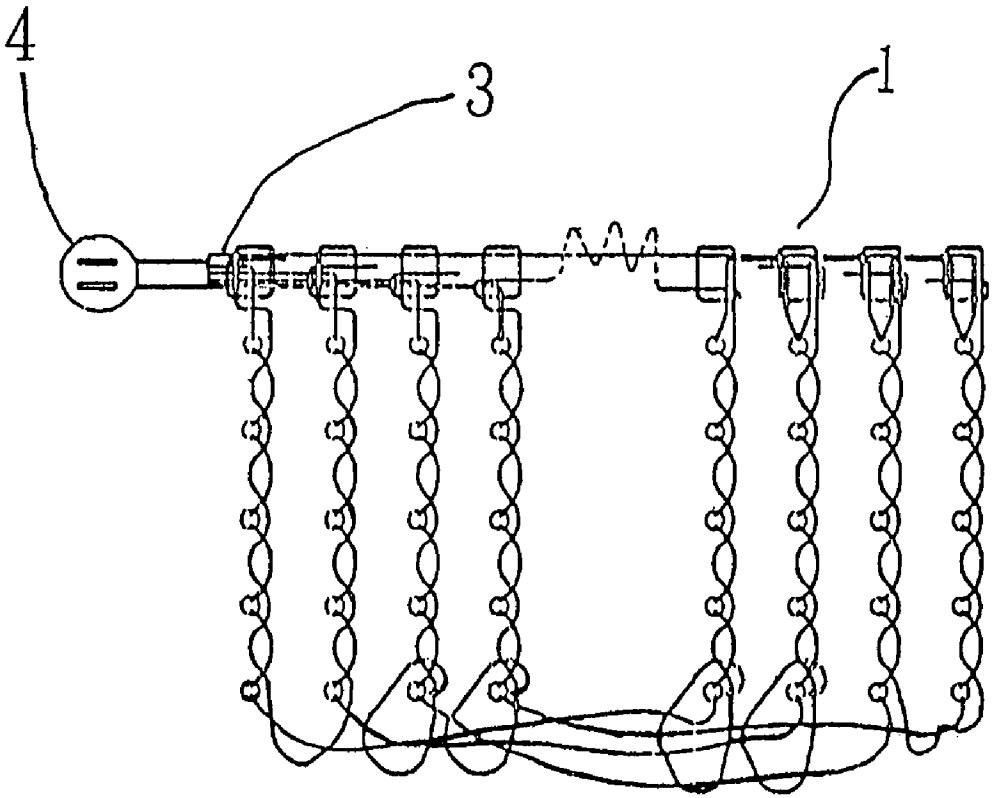
FIG. 1 is a schematic layout view of the present invention.
Figure 2:
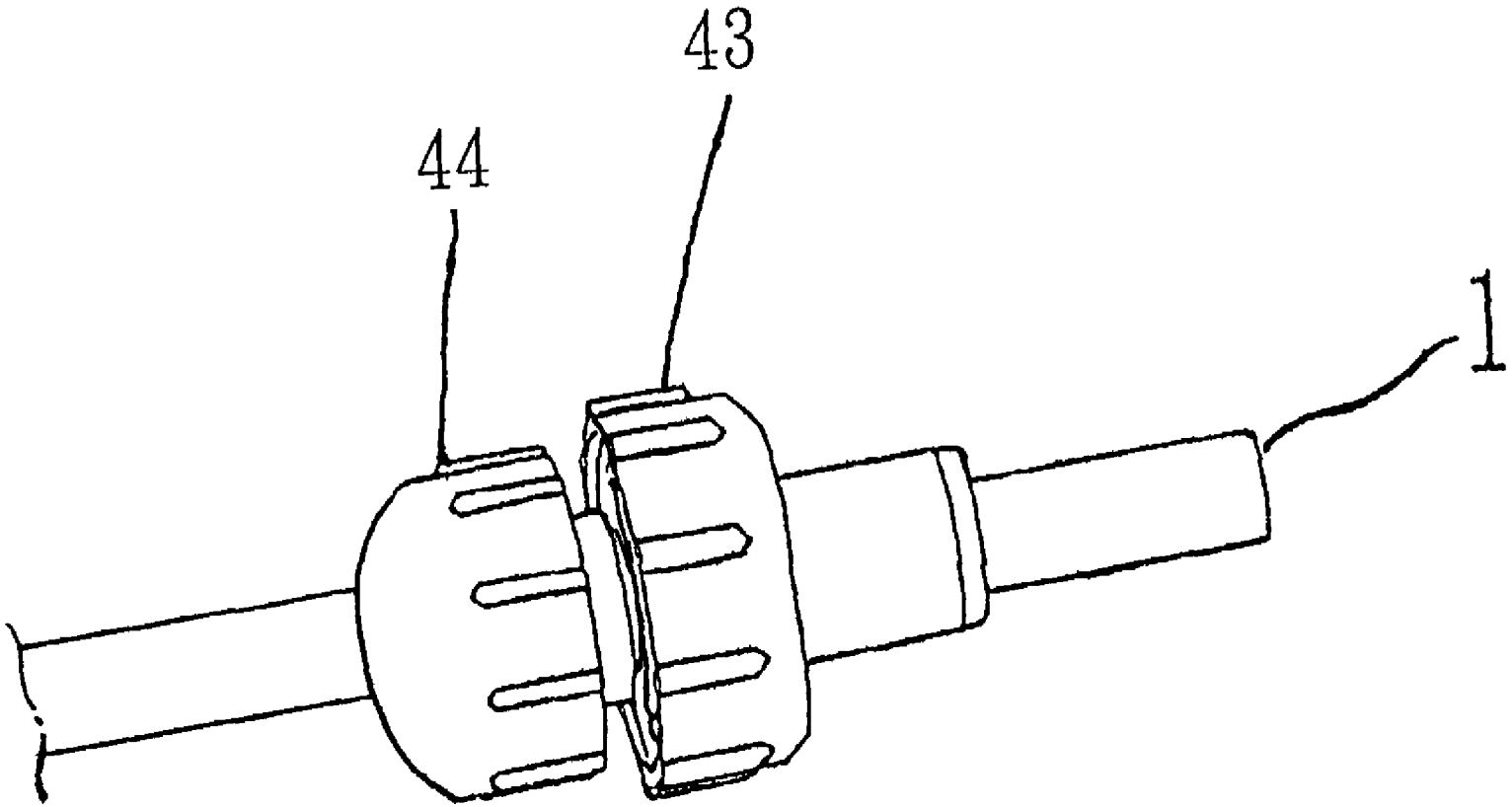
FIG. 2 is a three dimensional assembly view of the present invention.
Figure 3:
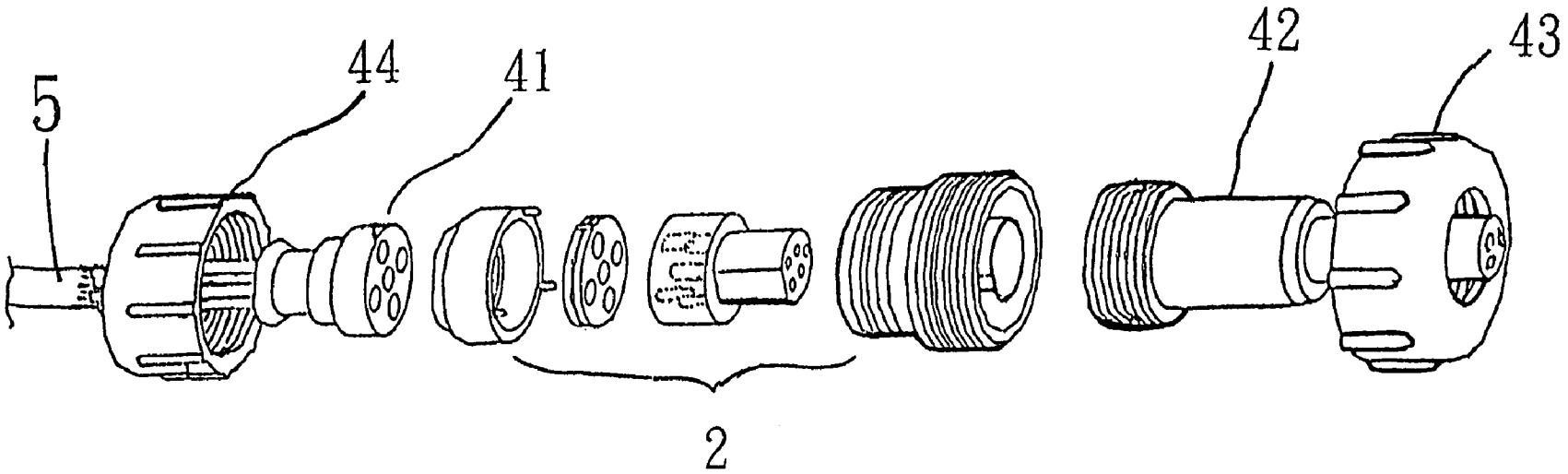
FIG. 3 is a three dimensional exploded view of the present invention.

For understanding the multi-functional ornamental lighting equipment of the present invention, please refer to FIG. 1 through 3 simultaneously. The lighting equipment of the present invention is composed of an ornamental lighting load 1, a function controller 2, a connecting junction 3 and a power supply 4.

The ornamental lighting load 1 is connected with a plurality of branch circuits each formed of a light string containing several lamps, and then these light strings are connected in series, parallel, or series-parallel to configurate into a desired figure, picture, or character(s) so as to appear as flexible ornamental lighting products or rope lighting products. The unit lighting element may be an incandescent lamp or a LED.

The function controller 2 is a multi-electronic composition formed of a plurality of ICs and a variety of electric and electronic components so as to be functional as a switching device, time counting device capable of rapidly bringing the ornamental lighting load 1 to a starting position to variably changing its state. Moreover, the function controller 2 is provided with an electronic synchronizing device and a prescribed IR/RF signal transmitting/receiving device. The former is functional for synchronizing operation and the latter is capable of transmitting and receiving the prescribed signal in the manner of remote control by means of coding or decoding, and capable of compatibly connecting with a computer, wireless mouse, wireless keyboard, wireless internet, distributor, wireless internet card, and portable cellular phone for practical application. One terminal of the function controller 2 is connected to the power input terminal, and the other terminal is an output terminal to the multi-branch circuits.

The connecting junction 3 is a plug 41 and receptacle 42 coupling by providing a plurality of male/female terminals in the plug 41 and receptacle 42 coupling mated fixedly with a fastener. The mated portions may be configurated into protuberances and recesses in planar or curved contact surfaces of a variety of sizes and shapes so as to assure a precise position when assembling. Besides, the mated portion may be formed of annular flanges and fissures of various sizes, shapes and numbers for discrimination so as to assure a precise and reliable combination.

The connecting junction 3 is, as a matter of fact, a plug 41 and receptacle 42 combination in which a plurality of conductors passes through with a function controller 2 sandwiched therebetween. A plurality of electric wires 5 can be installed inside the connection junction 3, one end of the electric wires 5 is connected to electric source plug, the other end is connected to ornamental lighting load 1. The two sides of the plug and receptacle combination 41, 42 are provided with two fasteners 43, 44 to securely grip the function controller 2 between the plug 41 and receptacle 42 such that the function controller 2 is able to control the variation of the lighting effect through controlling the electric signals passing through the conductors with its prescribed capability.

Figure 4:
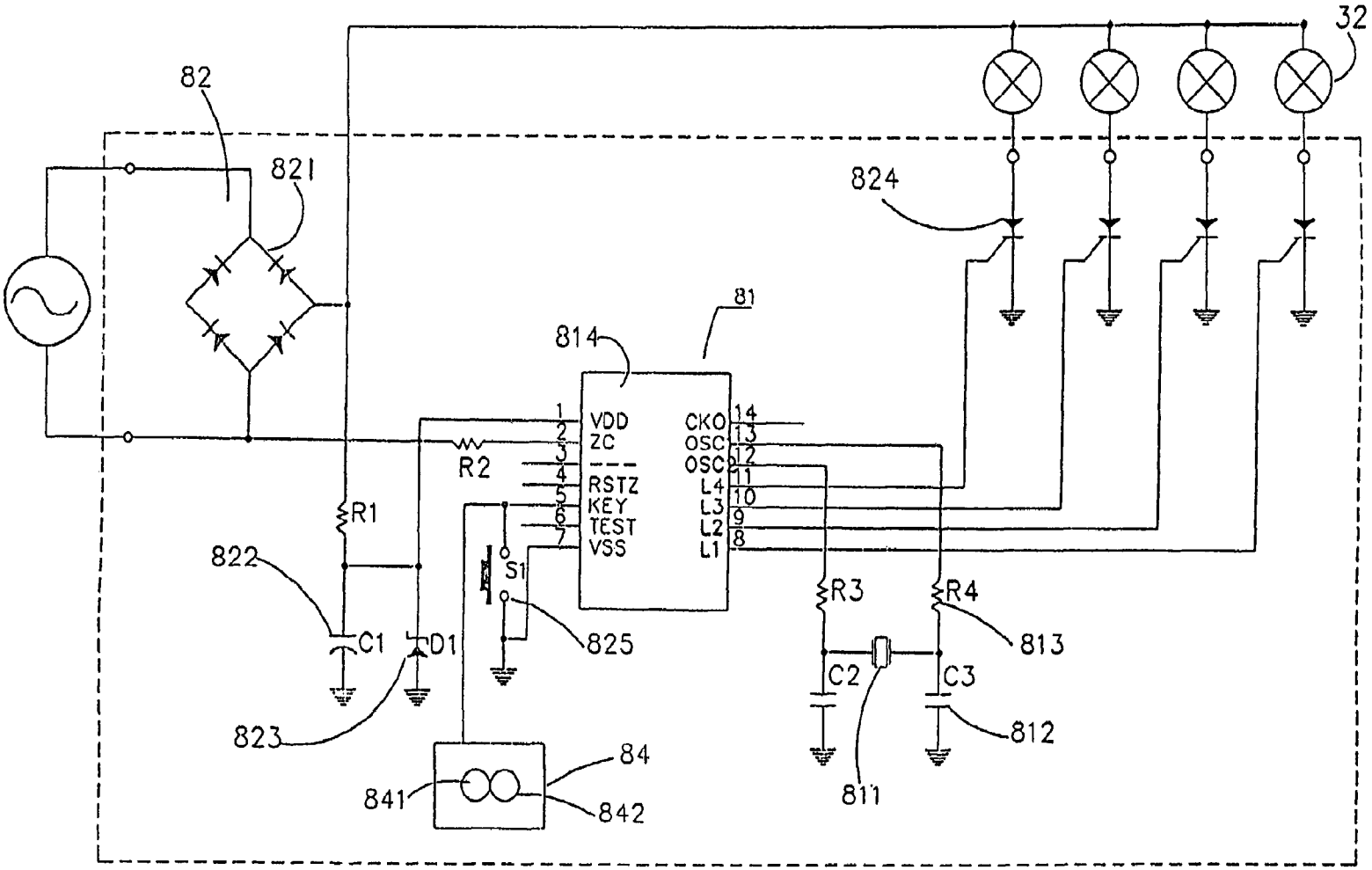
FIG. 4 is an electric circuit diagram of the function controller of the present invention.

The detail construction and the operational principles about the function controller 2 are illustrated in FIG. 4. Referring to FIG. 4, the function controller 2 includes an IC unit 81 for receiving power supply, signals and operating according to a prescribed mission and delivering a control signal; several auxiliary components 82 for the IC unit 81 for adjusting and varying the intensity and strength of the electric device; a power input terminal 21 for connecting the IC unit 81, and its auxiliary component 82 with the powering supply 5. The IC unit 81, which has the synchronizing effect, is composed of a quartz oscillator 811, a capacitor 812 and a resistor 813 to form an oscillating circuit and generate a reference frequency required for operating the components for the IC unit 82 so as to achieve a synchronizing effect. The auxiliary component 82 for the IC unit 81 includes a rectifier 821, a capacitor 822, a Zener diode 823, a SCR 824, a switch 825, and connector terminals for varying, regulating, stabilizing, pushing and actuating the operation of the ornamental lighting load, and interconnecting and protecting all the components in the IC unit 81.

There is an additional signal transmitter/receiver 84 in which a signal generator 841 and a signal receiver 842 are combined in an integral unit. The operative wireless signals include infrared ray (IR) and radio frequency (RF).

With this scheme, the power is introduce to the IC unit and its auxiliary components by the conductor to operate the light strings to produce turn on/off effect, and then any one of the IC unit generates signals to each IC unit so as to start or reset each of the lamp strings with a similar prescribed electric function thereby enabling a plurality of lamp strings to operate synchronically.

Alternatively, the IC unit and its auxiliary components together with the signal transmission wires may be removed and replaced by a signal transmitter and receiver so as to perform the signal transmission in wireless manner by infrared ray or microwave RF. The signal transmitter and receiver may be combined integrally in one piece. For practicability, the IC unit may be offered prescribed switching or restart function using automatic or manual switching means.

With this scheme, the IC unit provides control signals to the signal transmitter which then transmits the control signals to the signal receivers for all lamp strings so as to start or re-start each lamp string, even a farmost one will not fail to keep synchronous operation.

Inside the connecting junction, there is a space for holding function controller 2 or replaceable extra functional module, the replaceable extra functional module is a memory module, scrambler module, coder or decoder module, SIM module or internet module. Respective conductors, plugs, male and female terminals or contactors are reserved for the replaceable extra functional module and the function controller 2 itself.

The above mentioned replaceable extra functional module is sandwiched between the male and female terminals of the plug and receptacle. The replaceable extra function module is a memory module, scrambler module, coder or decoder module, SIM module or internet module, respective conductors, plugs and receptacle and the replaceable extra functional module so as to interconnect the power source and the multi-circuit lighting load.

Figure 5:
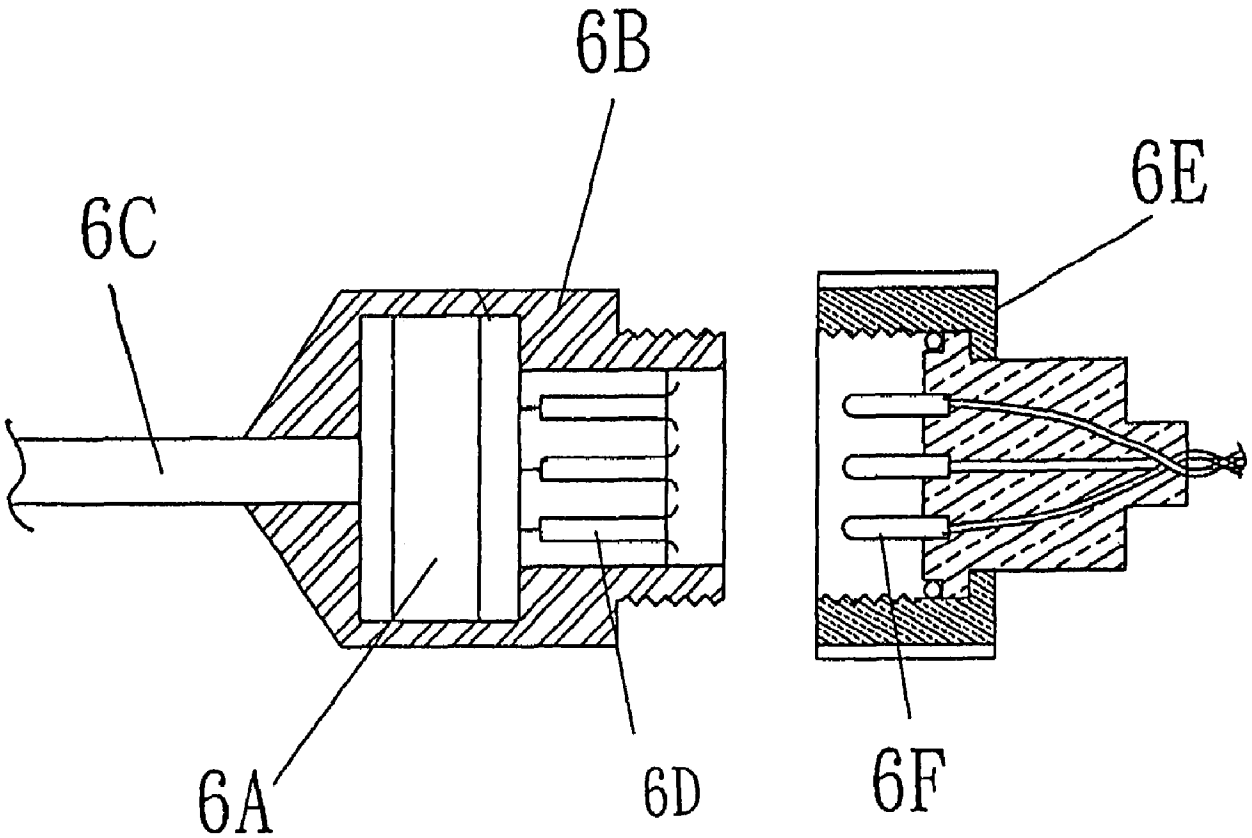
FIG. 5 is a drawing of the $2^{nd}$ embodiment of the present invention showing the connection of the connecting junction of present invention and the multi-functional ornamental lighting equipment.

FIG. 5 is a drawing showing another embodiment of the present invention. As shown in FIG. 5, the functional controller 6A can be made by mold injection of insulating plastics, and formed as a whole body with a female connector 6B, such that the electric contact portion is connected between the input terminal 6C and female socket element 6D of female connector 6B, while the female socket element 6D is exposed outside the body for male plug element 6F of the male connector 6E to connect with.

Figure 6:
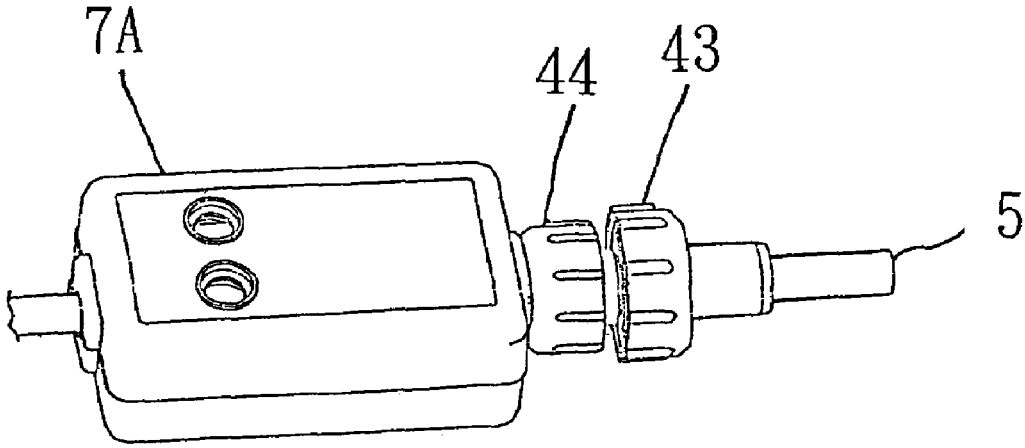
FIG. 6 is a drawing showing the $3^{rd}$ embodiment of present invention in using multi-functional ornamental lighting equipment.

FIG. 6 is a drawing showing the 3rd embodiment of present invention. As shown in FIG. 6, the function controller can be made by mold injection of insulating plastics, and formed as a whole body with a protective housing 7A at another end of the connection junction, and to form an electric connection with the connecting junction.

Figure 7:
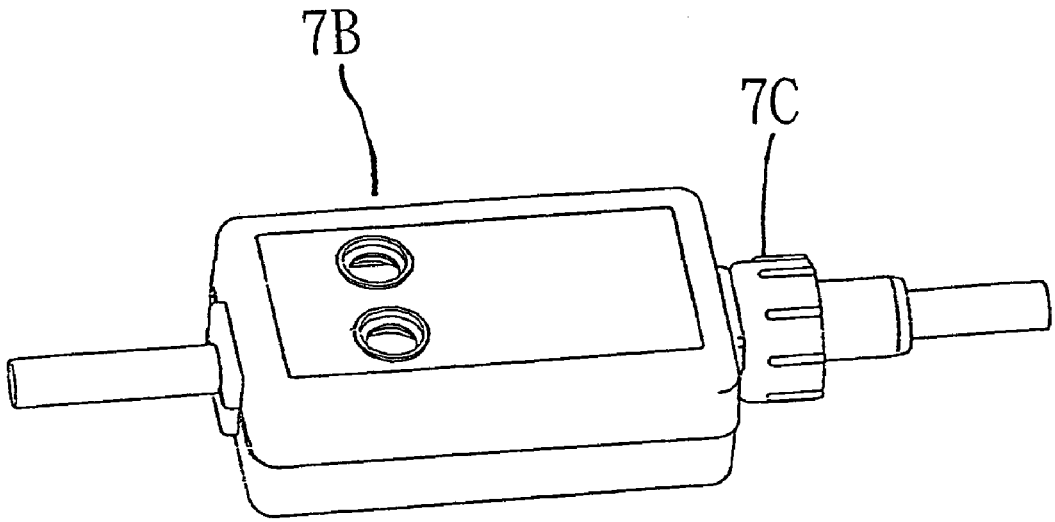
FIG. 7 is a drawing showing the $4^{th}$ embodiment of present invention in using multi-functional ornamental lighting equipment.

FIG. 7 is a drawing showing the 4th embodiment of present invention. As shown in FIG. 7, the function controller can be made by mold injection of insulating plastics, and formed as a whole body with a protective housing 7B at another end of the connecting junction having a fixing element 7C.

Figure 8:
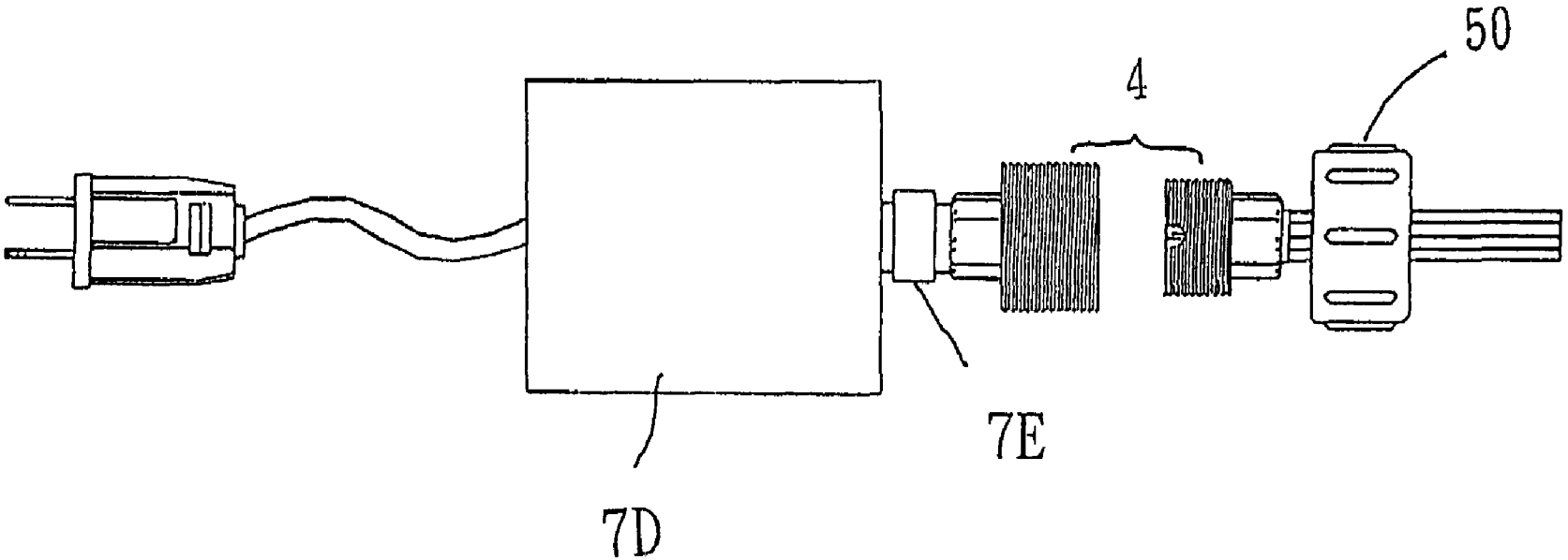
FIG. 8 is a drawing showing the $5^{th}$ embodiment of present invention in using multi-functional ornamental lighting equipment

FIG. 8 is a drawing showing the 5th embodiment of present invention. As shown in FIG. 8, the function controller can be made by mold injection of insulating plastics, and formed as a whole body with a protective housing 7D at another end of the connecting junction 4 having a fixing element 50. There is also provided a safety device 7E therebetween.

Other embodiments of the present invention will become obvious to those skilled in the art in light of the above disclosure. It is of course also understood that the scope of the present invention is not to be determined by the foregoing description, but only by the following claims.

What is claimed is:

1. A multi-functional ornamental lighting equipment, comprising:

an ornamental lighting load connected to form a plurality of branch circuits;

a connection junction: composed of a male connector and a female connector to be connected together by a fixing device, an input terminal is formed at one end and an output terminal is formed at another end, there is a pair of male and female plug elements for the male and female connector to connect together; the female connector is enveloped by insulation materials except for a female socket element, so as to enable the male plug pin to connect with;

a plurality of electric wires: to be respectively connected to the input and output terminals of male and female connectors;

a function controller composed by electronic elements having predetermined functions, said function controller also comprises an electric contact portion to be connected between the input terminal of said female connector and said female plugging elements, a connecting portion of said function controller and an electric appliance is formed as a whole body by mold injection of insulating plastics;

when the electric power is supplied to said input terminal, the ornamental lighting equipment will provide functional signals to the electronic equipment from said output terminal.

2. Multi-functional ornamental lighting equipment comprising:

an ornamental lighting load connected to form a plurality of branch circuits;

a connecting junction composed of a male connector and a female connector to be connected together by a fixing device, an input terminal is formed at one end of said connecting junction, and an output terminal is formed at another end of said connecting junction, there is a space and electric contact portion formed between the connection of said male connector and female connector;

a plurality of electric wires connected to the input and output terminals of male and female connectors;

a function controller comprising electronic elements having predetermined functions, said functional controller also comprises an electric contact portion provided in said space formed inside said connecting junction, the electric contact portion is connected with said electric contact portion formed between the connection of said male connector and female connector, when the electric power is supplied to said input terminal, the ornamental lighting equipment will provide functional signals to the electronic equipment from said output terminal, said function controller being formed of a plurality of ICs and a variety of electric and electronic components so as to function as a switching device, time counting device, dimmer, capable of sequential or random operation.

3. Multi-functional ornamental lighting equipment comprising:

an ornamental lighting load connected to form a plurality of branch circuits;

a connecting junction composed of a male connector and a female connector to be connected together by a fixing device, an input terminal is formed at one end of said connecting junction, and an output terminal is formed at another end of said connecting junction, there is a space and electric contact portion formed between the connection of said male connector and female connector;

a plurality of electric wires connected to the input and output terminals of male and female connectors, the output terminal of said connecting junction is connected to electric appliances or electronic equipments through said electric wires;

a function controller comprising electronic elements having predetermined functions, said functional controller also comprises an electric contact portion provided in said space formed inside said connecting junction, the electric contact portion is connected with said electric contact portion formed between the connection of said male connector and female connector, when the electric power is supplied to said input terminal, the ornamental lighting equipment will provide functional signals to the electronic equipment from said output terminal, a connecting portion of said function controller and the electric appliance is formed as a whole body by mold injection of insulating plastics.

4. A multi-functional ornamental lighting arrangement comprising:

an ornamental lighting load including a plurality of branch circuits;

a connecting junction including a first connector, a second connector and a fixing device connecting said first and second connectors, said fixing device being repetitively connectable and disconnectable of said first and second connectors, said first connector being connected to said ornamental lighting load, said second connector being connectable to a power supply;

a function controller connected between said first and second connectors of said connecting junction, said function controller selectively operating each of said plurality of branch circuits with power from said second connector.

5. An arrangement m accordance with claim 4, wherein:

said function controller includes one of a transmitting and receiving device for one of transmitting and receiving control signals indicating which of said branch circuits are to be operated.

6. An arrangement in accordance with claim 5, further comprising:

another ornamental lighting load including another plurality of branch circuits;

another connecting junction including a first connector, a second connector and a fixing device connecting said first and second connectors of said another connecting junction, said fixing device of said another connecting junction being repetitively connectable and disconnectable of said first and second connectors of said another connecting junction, said first connector of said another connecting junction being connected to said another ornamental lighting load, said second connector of said another connecting junction being connectable to a power supply;

another function controller connected between said first and second connectors of said another connecting junction, said another function controller selectively operating each of said plurality of another branch circuits with power from said second connector of said another connecting junction, said another functional controller includes a transmitting device for transmitting control signals to said function controller.

7. An arrangement in accordance with claim 6, further comprising:

synchronizing devices in each of said function controller and said another function controller, said synchronizing devices synchronizing operation of respective said branch circuits between said function controller and said another function controller.

* * * * *